United States Patent [19]

Ichikawa

[11] 4,380,128

[45] Apr. 19, 1983

[54] GREETING CARD WITH OPEN WORK ENGRAVING THEREON

[75] Inventor: Junju Ichikawa, Mikageishi, Japan

[73] Assignee: Kagawa & Co., Ltd., Osaka, Japan

[21] Appl. No.: 194,884

[22] Filed: Oct. 7, 1980

[30] Foreign Application Priority Data

Oct. 12, 1979 [JP] Japan ..... 54-142033[U]

[51] Int. Cl.[3] ..... G09F 1/00

[52] U.S. Cl. ..... 40/158 R; 40/124.1

[58] Field of Search ..... 40/160, 158, 124.1, 40/152, 615

[56] References Cited

U.S. PATENT DOCUMENTS

| | | | |
|---|---|---|---|
| 268,469 | 12/1882 | Edge | 40/615 |
| 1,014,312 | 1/1912 | Line | 40/152 |
| 1,850,857 | 3/1932 | Weindel | 40/615 |
| 1,852,274 | 4/1932 | Thurn | 40/615 |
| 2,948,977 | 8/1960 | Meissner | 40/158 R |
| 3,174,244 | 3/1965 | Walton | 40/124.1 |

FOREIGN PATENT DOCUMENTS

| | | | |
|---|---|---|---|
| 1062982 | 4/1954 | France | 40/158 |
| 1156141 | 5/1958 | France | 40/158 |
| 1849859 | 7/1960 | United Kingdom | 40/158 |

*Primary Examiner*—Gene Mancene
*Assistant Examiner*—Wenceslao J. Contreras
*Attorney, Agent, or Firm*—Birch, Stewart, Kolasch and Birch

[57] ABSTRACT

A greeting card with an open-work metallic or synthetic-resin engraving thereon.

3 Claims, 5 Drawing Figures

GREETING CARD WITH OPEN WORK ENGRAVING THEREON

BACKGROUND AND SUMMARY OF THE INVENTION

The present invention relates to a greeting card containing an open-work metallic or synthetic-resin disposed thereon.

Conventionally, to decorate Christmas cards, birthday cards, various invitational cards, guide cards, etc., hereinafter referred to as greeting cards, an open work pattern sheet is made by punching apertures paper which is then fixed onto the card. However, the patterns tend to break due to insufficient paper strength. Also, delicate patterns are made through the punching method. However it is difficult to make extremely delicate patterns.

In addition, since the open work pattern paper is likely to break, the paper is required to be reinforced with another paper applied on the reverse side thereof to prevent the open work paper from breaking. Thus, the ornamental effects of the open work pattern, namely, seeing through the inner side of the card are adversely affected.

According to the present invention, if, the open work engraving is made of a metallic material, or a synthetic resin, the above disadvantages are eliminated. The contraction of the present device will now be described hereinafter with reference being made to the drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a perspective view, of one embodiment of the present invention. Referring to FIG. 1, numeral 1 is an open work engraving, which is provided in advance through the etching of a thin piece of metallic plate or through the injection molding of a synthetic resin. The engraving 1 is placed on a hole 4, which is slightly smaller than the engraving the hole is made, the front to the face 3 of a greeting card 2 and the engraving is bonded in periphery of the hole. Accordingly, the inner face 6 of the card can be seen through the many holes 5 provided in the engraving, from the front face of the card.

FIG. 2 is an illustrating view showing the condition where the engraving 1 has not yet been fixed to the card 2.

FIG. 3 is a perspective view, showing another embodiment, of the present invention. A front flap portion 7 is provided behind the front face 3 of the card. A hole 9 is provided in the front flap portion 7 which is in alignment with the hole 4 of the front face 3. Also, the front face 3 of the card is bonded with the front flap portion 7 except at the top and around the periphery of the hole.

Figure 1:
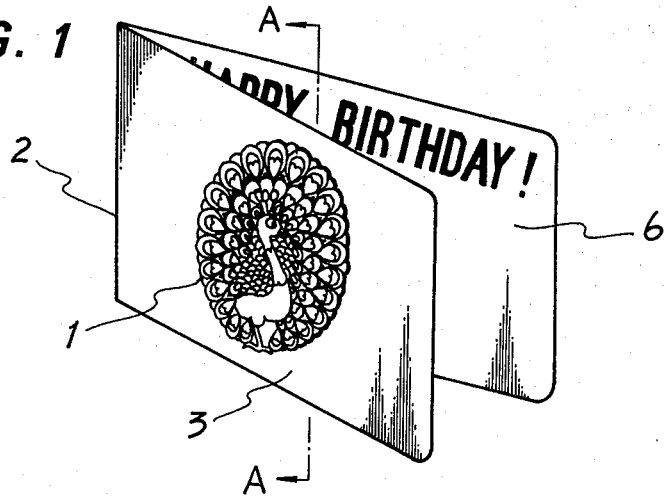
FIG. 1 is a perspective view showing an embodiment of the present invention.
Figure 2:
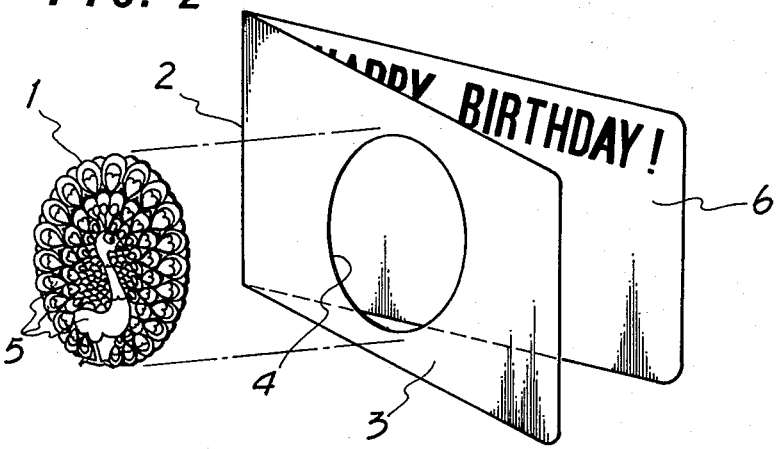
FIG. 2 is an illustrating view showing the condition where the engraving is not mounted.

Accordingly, in this embodiment the engraving 1 is removably disposed within the pocket defined by the front face 3 and the flap portion 7 and the inner face can be seen through the many holes provided in the engraving of this embodiment. This fact is the same as that of the embodiment of FIG. 1. Also, the engraving 1 can be removed from above of the card and can be used as a bookmark.

The back flap portion 8 prevents writing disposed on the inner face 6 of the card from being seen through the engraving and can be used to provide various colors and patterns for viewing through the engraving thereon.

Figure 3:
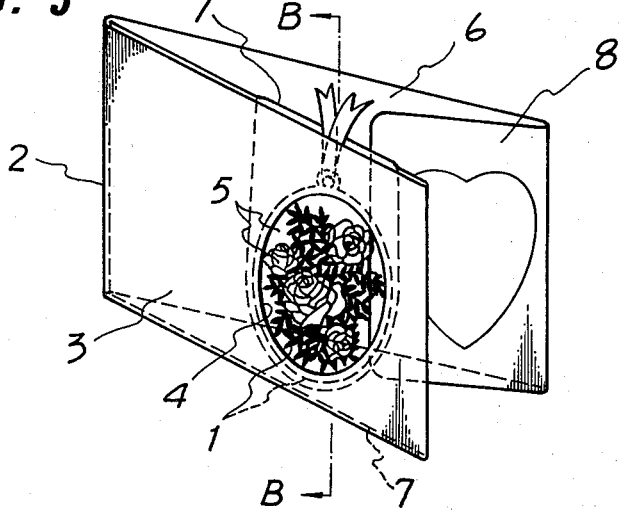
FIG. 3 is a perspective view showing another embodiment of the present invention.
Figure 4:
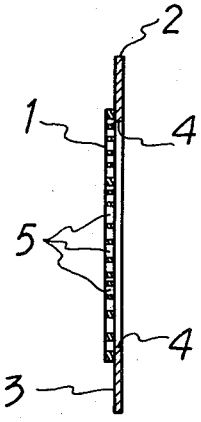
FIGS. 4 and 5 are, respectively, cross-sectional views taken along lines A—A and B—B of FIGS. 1 and 3.
Figure 5:
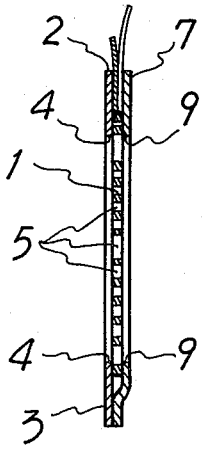

FIG. 4 and FIG. 5 are cross-sectional views taken along lines A—A and B—B of FIGS. 1 and 3 respectively.

According to the present invention, the hole to be drilled in the card is so simple that the hole can be easily made. Also, as the open work engraving is made a metal or synthetic resin, the engraving is rigid and can be mass-produced. Extremely delicate open work patterns can also be provided. In addition, not only gold, silver plating operation, but also various coloring operations can be performed.

Also, since the engraving is very sturdy reinforcing paper is not required to be pasted on the reverse side thereof. Since the inner face of the card can be completely seen through the engraving, the engraving itself can be an extremely pretty ornament. When colors of the front face 3 are well contrast with those of inner face 6 of the card or the back flap portion 8, the open work patterns become vivid, thus becoming a more attractive ornament.

Also, when a pattern, slightly larger than the engraving, such a pink-colored heart is painted on the back flap portion 8, the pink color can be seen, as the ground color for the open work pattern, through the engraving before the card is opened. Thus the open card and the heart-shaped pattern appears as a further, esthetic pleasure.

As described hereinabove, according to the present invention, an extremely pretty greeting cards, which can sufficiently display ornamental effects of an open lattice work pattern, can be manufactured.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A greeting card comprising
   - a front sheet having a front face and a back sheet containing an inner face,
   - an aperture disposed in the front face,
   - a front flap portion attached to the inner surface of the front sheet, across said aperture, said front flap portion combining with the inside surface of the front sheet to form a pocket, and
   - a decorative element made of a metallic or synthetic material and having a specific see-through design, removably disposed in said pocket, whereby a desired background can be seen through said decorative, see-through design.

2. The greeting card of claim 1 wherein the background is disposed on the back surface of said pocket.

3. The greeting card of claim 1 wherein the back surface of said pocket also has an aperture which coincides with the aperture in the front face, and the background is disposed on the inner face of the back sheet.

* * * * *